United States Patent [19]

Hickerson

[11] 4,194,694

[45] Mar. 25, 1980

[54] FLUID CONTROL VALVE

[76] Inventor: Frederick R. Hickerson, R.D. 6, Box 602, Newton, Sussex County, N.J. 07860

[21] Appl. No.: 897,304

[22] Filed: Apr. 18, 1978

Related U.S. Application Data

[63] Continuation-in-part of Ser. No. 773,987, Mar. 3, 1977, abandoned.

[51] Int. Cl.[2] ..... B05B 1/30

[52] U.S. Cl. ..... 239/533.1; 239/570; 251/44

[58] Field of Search ..... 239/452, 456, 533.2, 239/570, 583, 533.1; 251/30, 33, 43, 44, 252

[56] References Cited

U.S. PATENT DOCUMENTS

| | | | |
|---|---|---|---|
| 841,322 | 1/1907 | Hoxie | 251/252 |
| 2,176,699 | 10/1939 | Anderson | 239/444 |
| 2,799,466 | 7/1957 | Hickerson | 251/30 |
| 2,935,092 | 5/1960 | Stoner | 251/33 |
| 3,539,112 | 11/1970 | Thompson | 239/452 |
| 4,009,860 | 3/1977 | Lignau | 251/44 |
| 4,042,178 | 8/1977 | Veltrup et al. | 251/44 |

*Primary Examiner*—John J. Love
*Assistant Examiner*—Michael J. Forman
*Attorney, Agent, or Firm*—Nathan Edelberg; Robert P. Gibson; Max Yarmovsky

[57] ABSTRACT

A high pressure adjustable nozzle utilizes a vented piston valve in cooperation with a low torque hand adjusting cam element and control pin to easily open and close the nozzle orifice. Fluidic line pressure is applied to the fore and aft section of the piston valve to create forces which can adjustably regulate the flow of the nozzle from an infinitely variable full open valve position to a full closed valve position.

4 Claims, 4 Drawing Figures

FLUID CONTROL VALVE

GOVERNMENTAL INTEREST

The invention described herein may be manufactured, used and licensed by or for the Government for governmental purposes without the payment to me of any royalty thereon.

This application is a continuation-in-part of a prior application, Ser. No. 773,987 filed on Mar. 3, 1977 now abandoned, of Frederick R. Hickerson for a Fluid Control Valve.

BACKGROUND OF THE INVENTION

Various means have been used in the past to control the flow of a fluid from a nozzle. In almost all of the prior art designs, the operator on the remote control device operating the valve had to work against the line pressure. In high pressure flow control devices, such as fire nozzles, large forces are frequently required in order to control the flow-setting of the valve. Even prior art small garden hose nozzles are difficult to adjust, when varying the nozzle spray pattern, due to the force on the valve caused by the fluid pressure in the line. Prior art large fire hose adjustable spray nozzles generally require several men to hold and control the position of the nozzle because of the large force needed to overcome the combination of the reaction forces of the jet stream and the line pressure on the valve. In order to overcome these large forces resisting valve movement prior art adjustable nozzles generally required the use of massive valve designs, lever type mechanisms, line type glove and gate valves with massive stems and handles, all of which are frequently complex to design, expensive to fabricate and difficult to operate.

The present invention greatly furthers the state of the art disclosed in the U.S. Pat. No. 2,799,466. The present device provides for an infinitely variable controlled flow from the valve full open to full closed position. In contradistinction the above referenced patent is forced to an either completely "on" or completely "off" position. The present invention utilizes a cam-control pin combination, operatively positioned within the nozzle body and the piston valve, to adjust the fore and aft pressure on the piston valve, to reach an equilibrium pressure thereon, which will hold the piston valve at any intermediate position desired. In the present instance the piston valve has a fluid bypass passageway therethrough and a valve seat therein which cooperates with the cam controlled control pin to adjustably close or open the bypass passageway to control the pressure forces acting on the piston gate and thus the movement thereof.

SUMMARY OF THE INVENTION

This invention relates to a device for controlling fluid flow in a high pressure nozzle. Flow control is achieved by utilizing a vented piston valve member and balanced fluid pressure on the fore and aft sections of the piston valve to open and close the nozzle orifice with a minimum of operator effort. The present invention solves the problems aforementioned in the prior art high pressure adjustable nozzles by providing fluid flow control with a relatively small and inexpensive device which is simple to operate, small of size and weight, and reliable in performance due to reduced complexity of construction.

An object of the present invention is to provide an adjustable fluid control valve for a high pressure nozzle wherein the flow rate is infinitely controlled by creating a line pressure unbalance on the fore and aft sections of a vented piston valve which will either open or close the nozzle orifice as desired.

Another object of the present invention is to provide an adjustable fluid control valve for a high pressure nozzle wherein the cost of manufacture is substantially reduced from the prior art.

Another object of the present invention is to provide an adjustable fluid control valve for a high pressure nozzle of substantially reduced weight and size from prior art nozzles having the same flow and spray capabilities.

Another object of the present invention is to provide an adjustable fluid control valve for a high pressure nozzle which does not require substantial operator force to overcome high line pressure.

Another object of the present invention is to provide an adjustable fluid control valve for a high pressure nozzle which is more adaptable for remote control by mechanisms and systems of simplified and inexpensive design.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
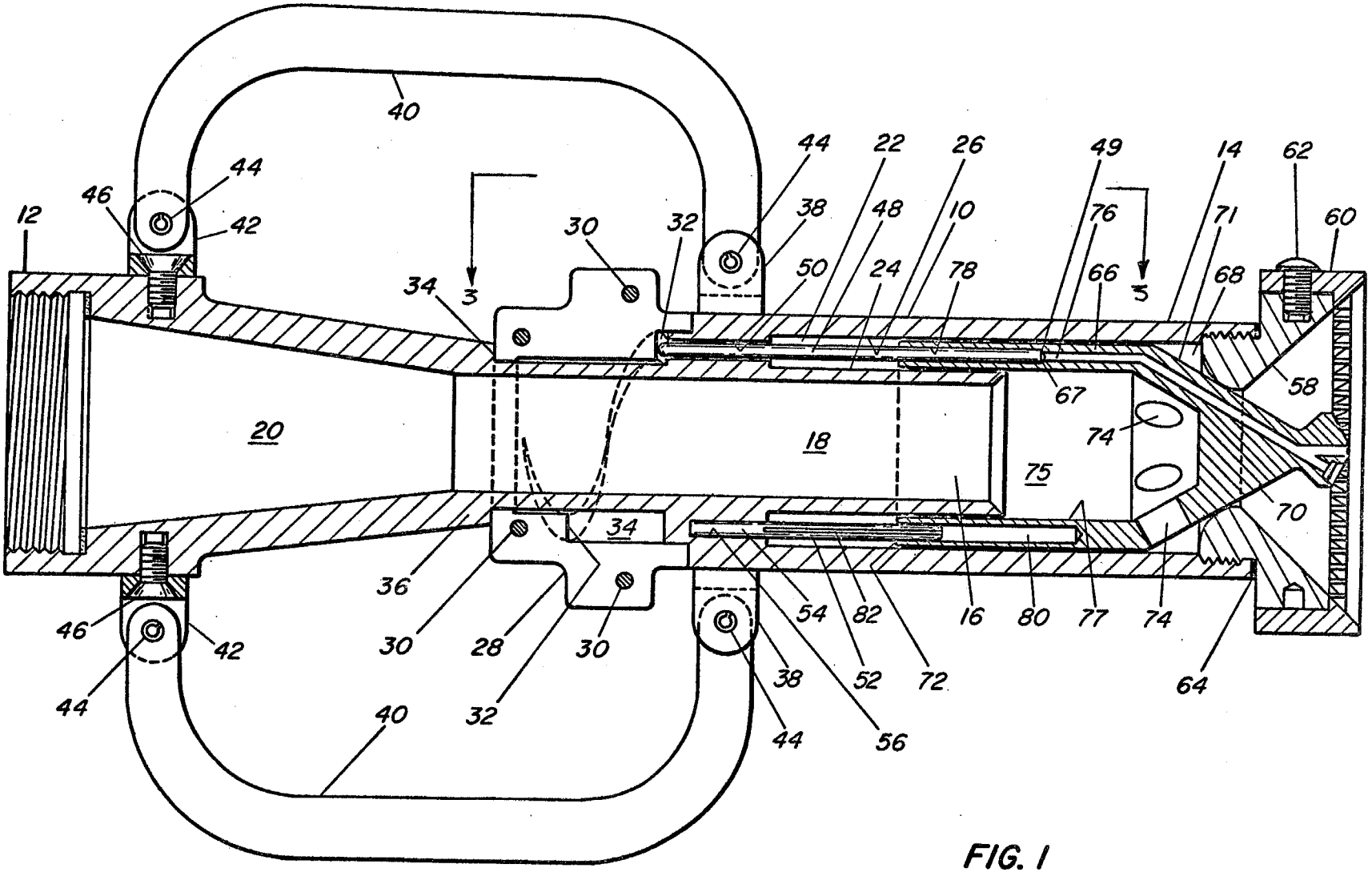
FIG. 1 is a partial longitudinal diametral cross-sectional view of an adjustable high pressure spray nozzle.
Figure 3:
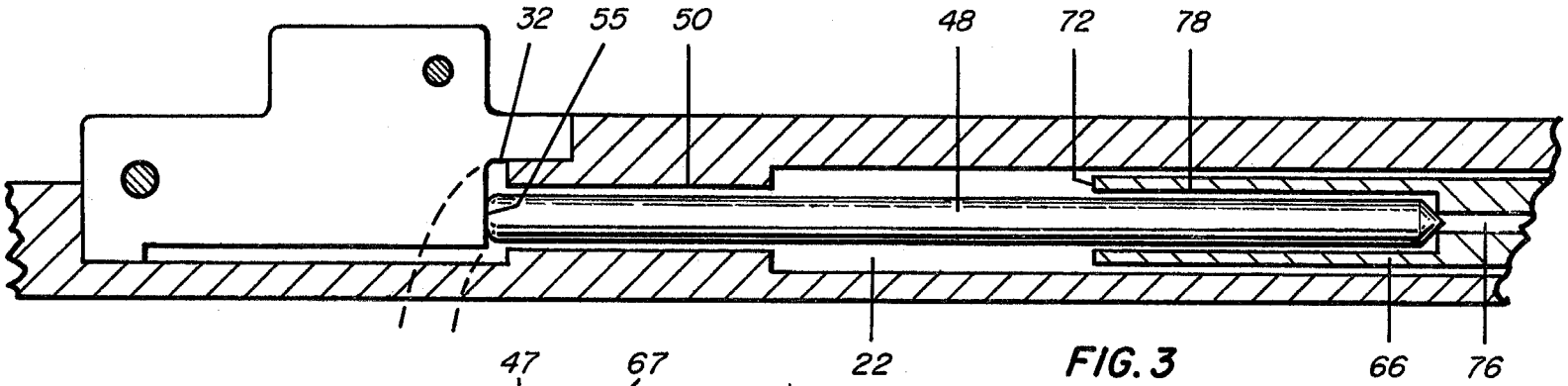
FIG. 3 is an enlarged partial cross-sectional view of a portion of wall of nozzle body member and piston valve of a control pin disposed therein taken along line 3—3 of FIG. 1.
Figure 4:
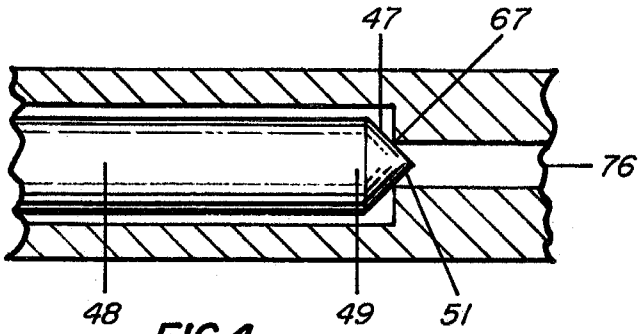
FIG. 4 is a further enlargement of the view shown in FIG. 3 of the control pin seated in the piston valve.

Referring now to FIGS. 1, 3 and 4 the adjustable high pressure tubularly shaped nozzle body member 10 has a venturi shaped internally threaded upstream aft end 12 and a cylindrically shaped internally threaded fore end 14. Intermediate the aft end 12 and the fore end 14 is a coaxially positioned integrally formed cylindrically shaped cantilever flow chamber section 16. Flow chamber section 16 has a flow cavity 18 therein which is axially aligned and communicates with a venturi shaped chamber 20. An annularly shaped piston groove 22 separates the exterior wall 24 of flow chamber 16 from the interior wall 26 of central tubular nozzle body 10 and is axially positioned therebetween. A split ring shaped control cam 28 is held together by screws 30. Cam 28 has a helical internal ramp groove 32 therein. Cam 28 is rotatably positioned in a stepped cam annular groove 34 which is in turn disposed intermediate the downstream end 36 of the venturi chamber 20 and the front end handle mount members 38. A pair of "U" shaped handles 40 are diametrically disposed with respect to each other and are fixedly attached to the rear end handle mount members 42 and the front end mount members 38 by roll pins 44. Rear end handle members 42 are fixedly attached to the nozzle aft end 12 by screws 46 and provided for aiding an operator to direct the flow from nozzle fore end 14. A control pin 48 is slidably longitudinally positioned in control pin bore 50, which communicates with stepped cam annular groove 34 on one end and annular piston groove 22 on the other end. Diametrically disposed from control pin 48 is an alignment pin 52 having one end 54 fixedly positioned in an alignment pin counterbore 56 which is longitudinally disposed in the nozzle body member 10 and communicating with annular piston groove 22. A nozzle seat member 58 is threadedly attached to the downstream nozzle fore end 14 and cooperates with the piston valve 66 in controlling fluid flow and in generating a spray. A spray deflector 60 is fixedly attached to the exterior rim of nozzle seat member 58 by machine screws 62. A Teflon gasket 64 is positioned intermediate the nozzle fore end 14 and the nozzle seat member 58. Piston valve 66 is slidably disposed within nozzle forward chamber 68 and has a conically shaped front end 70 and an open rear end 72 which loosely fits into annular piston groove 22 intermediate exterior wall 24 of the internal flow chamber and the interior wall 26 of the nozzle body 10. The piston valve front end has a plurality of vent orifices 74 which communicate with the nozzle forward chamber 68. One end of a fluid pressure relief passage 76 passes through and exits from the piston valve front end 70; the other end of relief passage 76 communicates with a control pin piston bore 78 and acts as a fluid control valve for fluid pressure generated against the piston valve rear end 72. An alignment pin piston counterbore 80 is longitudinally located in the piston valve 66 diametrically opposite to the control pin piston bore 78. A longitudinal groove 82 disposed in alignment pin 52 prevents pressure build up in the alignment pin as piston valve 66 moves toward the left.

Figure 2:
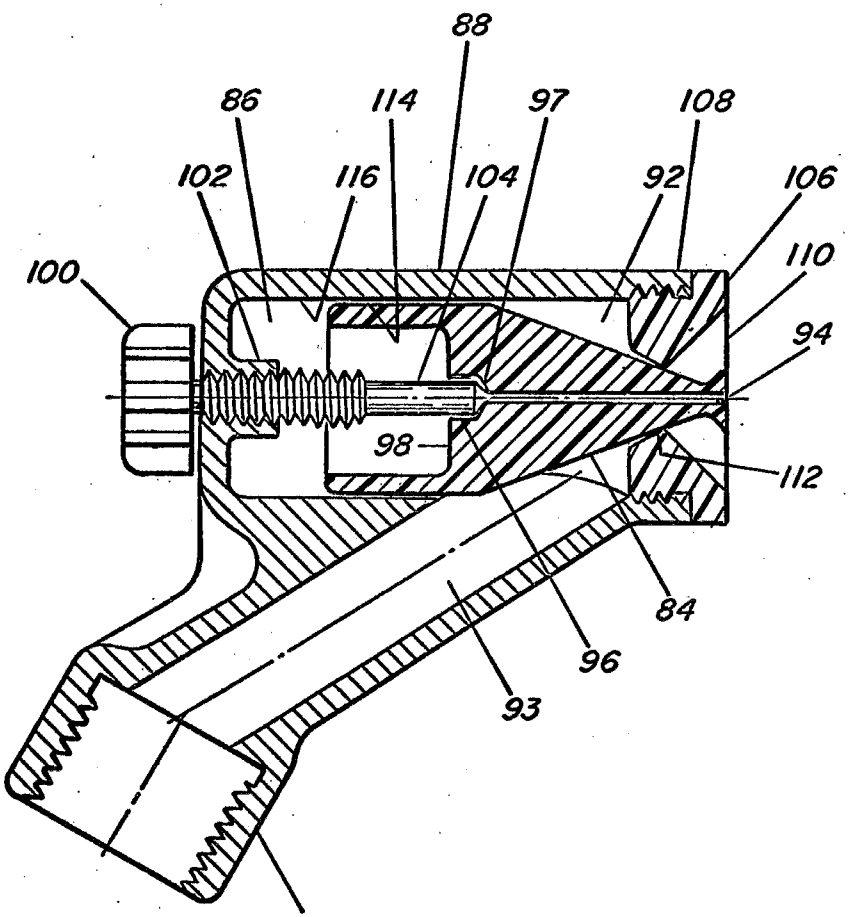
FIG. 2 is a modification of FIG. 1 showing a longitudinal cross-sectional view of the invention as an adjustable garden hose nozzle attachment.

Referring now to FIG. 2, a modification of the nozzle shown in FIG. 1 shows a garden hose application. A piston valve member 84 is slidably positioned in a piston chamber 86 of a die cast nozzle body member 88. The upstream end 90 of the nozzle body 88 communicates with the forward end 92 of the piston chamber 86 through connecting duct 93. A pressure relief passage 94 passes axially through the piston valve member 84 and is coaxial with a control pin bore 96 located in the counterbored piston rear end 98. A flow control actuator 100 threadedly passes through an internally threaded axially aligned body boss member 102. Actuator integral control pin 104 slidably fits with clearance into the control pin bore 96. Control pin 104 fits against piston control pin seat 97 when the nozzle is closed. A nozzle seat and spray control member 106 is threadedly attached to the forward threaded end 108 of the body member 88.

In operation, referring to FIGS. 1, 3 and 4, control pin 48 is allowed to move in a rearward direction by rotating the split ring control cam 28 so that the control pin 48 is partially withdrawn from the control pin piston bore 78 by liquid pressure being exerted on front portion 47 of forward end 49 of pin 48. The distance of withdrawal represents the resultant flow rate of the valve. The pressure balance on the piston valve 66 is disturbed by the movement of the control pin 48, causing movement of the piston in order to regain the balance. When the control pin 48 is in its closed position, as shown in FIGS. 1, 3 and 4 a greater fluid force is exerted on the rear end 72 of the piston valve 66 than on the downstream front end 70 and 71. The control pin 48 allows or stops the flow of fluid exiting from the annular piston groove between the piston rear end 72 and the nozzle body 10 by throttling the pressure relief passageway 76.

It should be noted that there is no liquid forces acting on the front portion 51 of the control pin 48 exposed to the relief passage 76 when the control pin tip 49 is seated against the control pin seat 67 of the relief passage 76. It should also be noted that the helical internal ramp 32 is vented to the atmosphere and that no fluid liquid pressure acts on the rear end 55 of control pin 48. Slight fluid leakage will occur through the clearance space between the control pin 48 and the control pin bore 50, but has no appreciable effect on the operation of the fluid control valve. This leakage can be eliminated by use of an O-ring or gland seal located in the control pin bore 50, but which is not shown in this embodiment in order to avoid undue complexity. Fluid pressure in the annular groove 22 is caused by the controlled leakage of fluid entering from the internal flow chamber flow cavity 18 through piston chamber 75 and through the space between the exterior wall 24 of the internal flow chamber 16 and the interior wall 77 of piston valve 66 and also through the space between the exterior wall of the piston valve 66 and the interior wall 26 of the central tubular body 10. When the control pin 48 is permitted to move rearwardly by cam groove 32, toward the left of FIGS. 1, 3 and 4 the pressure in the annular groove 22 is reduced by fluid exiting relief passage 76, allowing fluid pressure on the downstream fore end 70 and 71 of the piston valve 66 to push it rearward until the control pin tip 49 again throttles the fluid exiting through the piston passageway 76 and the pressure in the annular groove 22 is increased to provide a force balance on the piston valve 66 sufficient to hold it at the desired chosen steady flow rate. This chosen flow rate continues until an operator again moves the control cam 28 to create another pressure unbalance on the piston valve 66 with resultant movement to a different flow rate position. It should be noted that while the piston valve 66 follows the control pin 48, the only time the piston control pin seat 67 contacts the control pin tip 49 is when the valve is in its closed position shown in FIG. 1. Operation of the modification shown in FIG. 2 is substantially as that aforedescribed for the device shown in FIG. 1. In the latter instance the control pin is in axial alignment with the piston valve member 84, however, the function of the control pin 48 of FIG. 1 and control pin 104 of FIG. 2 are substantially the same. In each instance the control pins are utilized to regulate the balance of pressure forces being exerted on the fore and aft portions of a piston valve to control a fluid flow rate. In FIG. 2 operation, the fluid entering the upstream end 90 of the nozzle body 88 exits through the nozzle orifice 110 when the piston valve member 84 is moved to the left of nozzle seat member 106. The position of piston valve member 84 in relationship with the nozzle body member 88 determines the output flow rate and dispersion of the flowing fluid. When the piston valve member 84 is caused by the adjustment of flow control actuator 100 to move off nozzle seat 112 of nozzle seat member 106, the flow rate of the fluid exiting from orifice 110 increases. The fluid flow starts as a fine conical spray. With the continued adjustment of the flow control actuator 100 so that it moves toward the left, the flow rate of the fluid will increase to a heavier conical spray until it becomes a solid stream. Screwing the actuator 100 "in", or toward the right of the drawings, the actuator 100 will cause the piston valve member 88 to move downstream reversing the above described flow rate and dispersion pattern.

In the normally closed position, shown in FIG. 2, the actuator 100 is screwed "in", or toward the right until, the control pin 104 front end rests firmly against piston control pin valve seat 97 and the piston conical end is seated firmly against nozzle seat 112. With a fluid pressure source such as a garden hose attached to the upstream end 90 of the nozzle body member 88 and having the fluid source providing fluid pressure, and the assembly in a normally closed position, the line fluid pressure acts in connecting duct 93, in the forward end 92 of the piston chamber 86, and in piston chamber 86 to hold the piston valve member 84 in the closed position. It should be noted that a clearance space has been intentionally established between the exterior cylindrical surface 114 of the piston valve member 84 and the interior wall 116 of the nozzle body member 88 in order to allow the fluid pressure in duct 93 and forward piston chamber 92 to be transmitted into rear piston chamber 86. In the closed position the force holding the piston valve member 84 on nozzle seat 112 is the line pressure in rear piston chamber 86 acting on the full cross sectional area of the piston valve member 84, less the area of the pressure relief passage 94 which is covered by the pointed shaft of control pin 104. The force to move the piston valve member 104 off nozzle seat 112 is the line pressure in the forward end of piston chamber 92 acting on the full cross sectional area of the piston valve member 84 less the equivalent circular cross sectional area of piston valve member disposed immediately in front of the rear upstream edge of nozzle seat 112. Since the line pressure in chambers 86 and 92 are the same and since the area over which this pressure acts on the closing side of piston valve member 84 is greater than that on the front end of piston valve member 84, a positive force holds the piston valve member 84 in a closed position.

To open the assembly shown in FIG. 2, the actuator 100 is unscrewed to a desired position. As the pointed shaft 104 moves off nozzle seat 97, the pressure in the chamber 86 is reduced because it is restricted by the clearance between the exterior cyclindrical surface 114 of the piston valve member 84 and the interior wall 116 of the nozzle body member 88. Because of the reduced pressure in rear end piston chamber 86, the force holding the piston valve member 84 on nozzle seat 112 will be less than that caused by the fluid pressure in forward piston chamber end 92 which forces the piston valve member 84 off nozzle seat 112 thus allowing fluid to flow out of orifice 110. The piston valve member 84 will move rearward, to the left of the drawing, until the shaft point of control pin 104 throttles the flow rate of the fluid exiting from rear end piston chamber 86 through the relief passage 94. This throttling action will result in a balanceing of forces on each side of the piston, due to the pressure differential between the forward and rear piston chambers 92 and 86 respectively.

As aforedescribed, moving the actuator knob 100 to any desired position will result in automatic and near instantaneous movement of the piston valve member 84 with resulting fluid flow rate change. The piston valve member 84 moves in either fore or aft direction by the balancing of pressure forces and is not pushed by the pointed shaft of control pin 104. The only time the pointed shaft of control pin 104 would physically contact piston control pin valve seat 97 is when the piston valve member 84 is in its closed position.

The design configuration of the tip of the piston valve member 84 and the nozzle seat 112, together with the amount the piston valve 84 is moved rearwardly determines the flow rate and dispersion of the fluid. An operator can quickly obtain the desired outflow from the valve by rotation of the actuator 100.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent of the United States is:

1. An adjustable fluid control valve comprises:

a tubularly shaped nozzle body member having a venturi shaped internally threaded aft end, a cylindrically shaped internally threaded fore end, a flow chamber section axially disposed intermediate said aft end and said fore end of said body member, said flow chamber section having a flow cavity therein axially aligned and communicating with a venturi shaped chamber in said aft end, a cantilever flow chamber section being separated from the interior wall of said nozzle body member by an annularly shaped piston groove, a longitudinally disposed control pin bore operatively positioned in said nozzle body member having one end communicating with said annularly shaped piston groove, a stepped cam annular groove circumferentially disposed on said nozzle body member intermediate said aft end and said fore end, an alignment pin counterbore longitudinally disposed in said nozzle body member, said alignment pin counterbore communicating with said annularly shaped piston groove, and a nozzle forward chamber located in said nozzle body member fore end;

valve means slidably positioned in said cylindrically shaped fore end of said nozzle body member for controlling the rate of fluid flow through said nozzle body member, said valve means providing fluid pressure relief to balance the forces exerted on a front and rear end of said valve means at a selected fluid flow rate which includes;

a piston shaped valve member having a conically shaped front end and an open rear end, said rear end loosely fitting into said annularly shaped piston groove, said front end having a plurality of vent orifices therein which communicates with said nozzle forward chamber of said nozzle body member and a pressure relief passage having a front end passing through and exiting from said piston valve member front end, a control pin piston bore longitudinally disposed in the open rear end having a control pin seat end which communicates with the other end of said pressure relief passage, and an alignment pin piston counterbore longitudinally disposed in said open rear end diametrically located opposite to said control pin piston bore;

cam means rotably positioned on said nozzle body member for adjustably regulating the position of said piston shaped valve member to infinitely control fluid flow through said nozzle body member from a full on position to a full closed position; and spray deflector means threadedly attached to said threaded fore end of said nozzle body member for providing a nozzle seat for said piston shaped valve member, and for generating a variable fluid spray pattern therefrom.

2. An adjustable fluid control valve as recited in claim 2 wherein said cam means comprises:

a split ring control cam member rotatably disposed in said stepped cam annular groove, said cam member having an internal helically shaped ramp groove therein:

a control pin slidably disposed in said control pin piston bore, said control pin having one end in contact with said helically shaped ramp groove of said split ring control cam and the other end disposed in said control pin piston bore, said control pin other end being adjacent said control pin seat of said control pin piston bore.

3. An adjustable fluid control valve as recited in claim 3 wherein said nozzle body member further includes an alignment pin having one end fixedly disposed in said alignment pin counterbore of said nozzle body member and the other end slidably disposed in said alignment pin piston counterbore.

4. An adjustable fluid control valve as recited in claim 3 wherein said nozzle body member further includes handle means fixedly attached thereto for aiding an operator to direct the fluid flow from the fore end of said nozzle body member toward a target.

* * * * *